United States Patent [19]

Ganz et al.

[11] 3,956,868

[45] May 18, 1976

[54] CARTON OPENING, FILLING AND CLOSING APPARATUS

[75] Inventors: Robert H. Ganz, Saddle River; John H. Myers, Bergenfield; Edward A. Waleck, Closter, all of N.J.

[73] Assignee: Federal Paper Board Company, Inc., Montvale, N.J.

[22] Filed: Nov. 6, 1974

[21] Appl. No.: 521,247

[52] U.S. Cl. ..... 53/48; 53/154; 53/159; 53/186; 53/202; 53/251

[51] Int. Cl.[2] ..... B65B 5/10; B65B 35/44; B65B 43/26

[58] Field of Search ..... 53/48, 154, 159, 168, 53/186, 202, 237, 251, 284

[56] References Cited

UNITED STATES PATENTS

| | | | |
|---|---|---|---|
| 2,441,372 | 5/1948 | Quigley et al. | 53/186 X |
| 2,756,553 | 7/1956 | Ferguson et al. | 53/159 |
| 2,877,614 | 3/1959 | Currivan | 53/48 X |
| 2,896,520 | 7/1959 | Woelfer | 53/186 X |
| 3,037,431 | 6/1962 | McGihon | 53/48 X |
| 3,174,259 | 3/1965 | Jones et al. | 53/186 X |
| 3,300,947 | 1/1967 | Fahrenbach | 53/186 |
| 3,332,199 | 7/1967 | Wong | 53/48 X |
| 3,645,068 | 2/1972 | Langen | 53/186 |
| 3,766,704 | 10/1973 | Ganz | 53/48 |
| 3,778,959 | 12/1973 | Langen et al. | 53/160 X |

FOREIGN PATENTS OR APPLICATIONS

| | | | |
|---|---|---|---|
| 495,031 | 8/1953 | Canada | 53/186 |

*Primary Examiner*—Robert L. Spruill
*Attorney, Agent, or Firm*—Guy A. Greenawalt

[57] ABSTRACT

An apparatus for opening collapsed tubular cartons, filling the same with a plurality of product filled beverage cans, or the like, and closing the carton flaps wherein successive cartons, in flattened form, are fed onto a traveling conveyor with end closure flaps extending at opposite sides of the conveyor and double rows of the can units are advanced on infeed conveyor lines traveling along opposite sides of the carton conveyor while the carton carrying conveyor advances the cartons through associated mechanism which cooperates with the conveyor in opening the cartons into tubular form as they are advanced to a filling area or station where the cans are grouped and the required number guided into the opposite open ends of each carton by a series of traveling chains having can engaging lugs thereon which are spaced to properly group the cans and control their movement into the cartons in proper timed relation to the movement of the conveyor which then advances the filled cartons through associated mechanism for closing and locking the flaps at opposite ends of the cartons.

18 Claims, 15 Drawing Figures

2A
2B
10
14
14'
16
30
30'
36
40'
42'
48
50
52
53
54
56
57
60
126
126'
127
127'
F2
M2
TC3
C
P
9
10

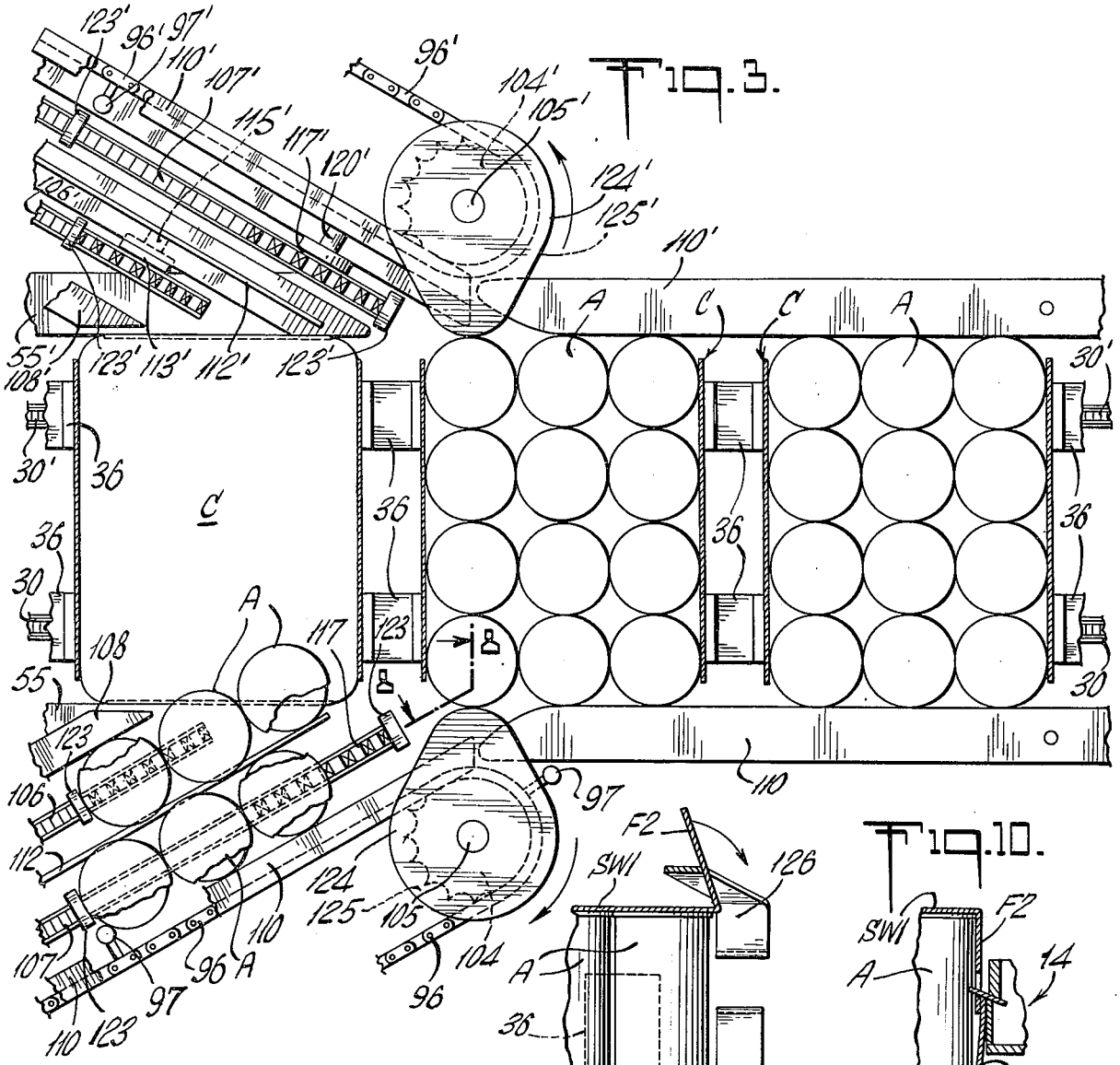
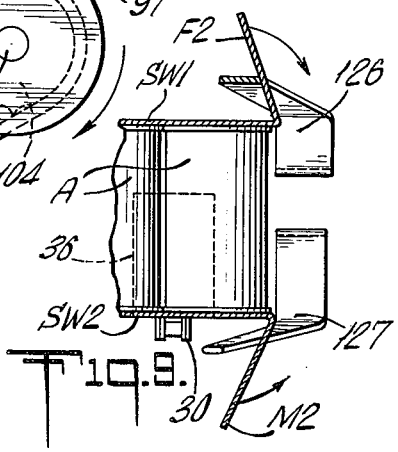
Fig. 9.
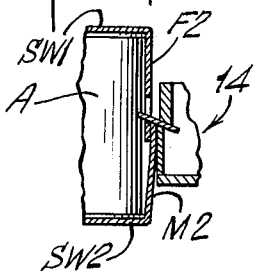
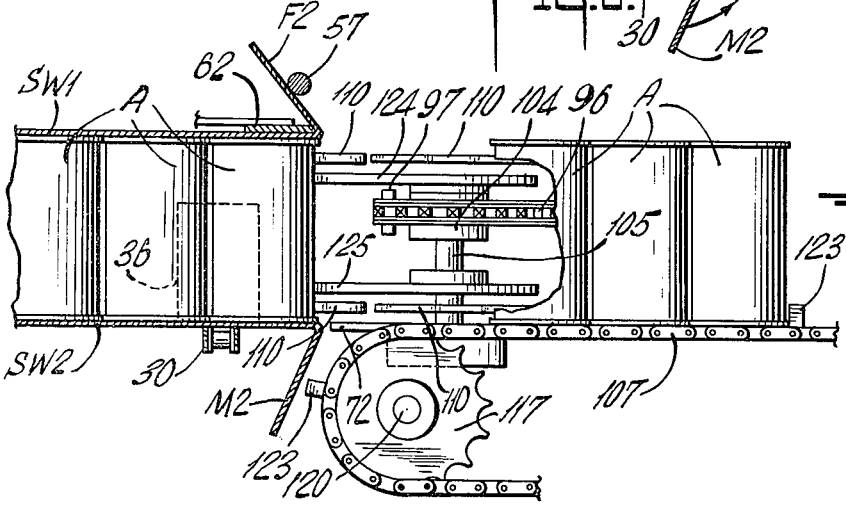
Fig. 8.

CARTON OPENING, FILLING AND CLOSING APPARATUS

This invention relates to packaging machinery and is more particularly concerned with improvements in machines for opening, filling and closing tubular cartons of the type which are supplied in flattened or collapsed condition for use in the packaging of a plurality of articles, such as, cans of beverage products.

In the packaging of products, such as canned beer, soft drinks and the like, various arrangements have been employed in providing a single package unit with a plurality of the canned product units. While the most commonly used arrangement has been the six can package employing a wraparound paperboard blank or a chime gripping plastic panel, other arrangements have been developed especially for marketing a larger number, generally 12, of the cans in a single unit package. In one such package which has been developed, a tubular carton is employed which may be fabricated in initially collapsed or flattened condition for delivery to the canning plant, which is designed to receive a predetermined number of the cans, generally 12, and which is provided with end closure flaps for confining the cans in row or tier formation therein. Packages employing cartons of this type have been accepted in the trade but difficulty has been encountered in providing economical means for opening, loading and closing the collapsed cartons. Where cartons have been employed with end panel closures which require sealing with adhesives, generally, hot melt type adhesives have been resorted to in an effort to eliminate the long compression sections which are required with cold adhesives and this has proven to be too costly in terms of material and skilled labor requirements. In order to overcome the disadvantages of the adhesively sealed carton, which is also difficult to open when the end flaps are properly sealed, a carton of this type has been developed in which end closure flaps are provided with locking or latching elements which are interengaged when the closure flaps are folded to overlapped end wall forming position. Cartons having closures of this type cannot be filled and properly closed with the efficiency desired on conventional carton handling equipment. Consequently, there is a need for machines which will operate more efficiently in handling packaging operations where this type carton is employed. It is, therefore, a general object of this invention to provide improved carton handling apparatus which is capable of performing in a highly efficient manner the operations required to open collapsed tubular cartons, fill the cartons with a plurality of articles, such as, canned beverage units, and complete the packages by interengaging locking elements on foldable closure forming end flaps.

A more specific object of the invention is to provide an improved package forming machine having means for opening flattened tubular cartons while they are advanced to a loading station or area, means for filling the cartons with a predetermined number of can units by moving groups of the cans into opposite open ends of the cartons as the cartons are advanced through the loading area and means for closing and locking the end closure flaps to complete the package forming operations.

A further object of the invention is to provide a package forming machine which comprises a travelling conveyor with means for depositing thereon successive collapsed tubular cartons, means along the conveyor for opening the cartons into open ended tubular form, feed means for advancing a line of cans along opposite sides of the traveling conveyor, means at a carton loading area for grouping the cans and directing a predetermined number thereof into converging paths and into the opposite open ends of the cartons while the cartons are advancing through the loading area so as to fill the cartons, and means for thereafter closing and locking end flaps on the cartons so as to confine the cans in a satisfactory manner and complete the packaging operations.

Another object of the invention is to provide in a machine for packing a plurality of articles, for example, canned beverages, in a tubular carton, a traveling conveyor for supporting the cartons in an open end position while they are advanced through a loading area, and an article feeding means at opposite sides of the conveyor with means for grouping the articles and guiding the articles into the carton open ends thereof, in predetermined numbers, so as to fill the cartons while they are advancing on the supporting conveyor.

These and other objects and advantages of the invention will be apparent from a consideration of one form of the apparatus which is shown by way of illustration in the accompanying drawings wherein:

FIG. 3 is a fragmentary plan view to a still larger scale showing a portion of the machine at the loading station or loading area;

FIG. 8 is a fragmentary sectional view taken on the line 8—8 of FIG. 3;

FIG. 9 is a fragmentary cross section taken on the line 9—9 of FIG. 2B to an enlarged scale;

FIG. 10 is a fragmentary cross sectional view taken on the line 10—10 of FIG. 2B;

Figure 11:
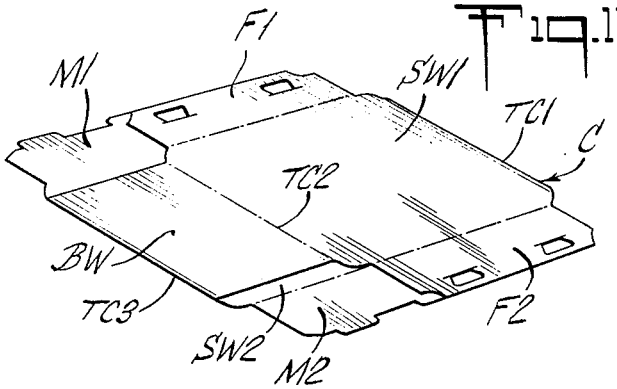
FIG. 11 is a perspective view showing, in folded condition, the carton which is adapted to be employed in forming the package on the machine of the present invention.
Figure 12:
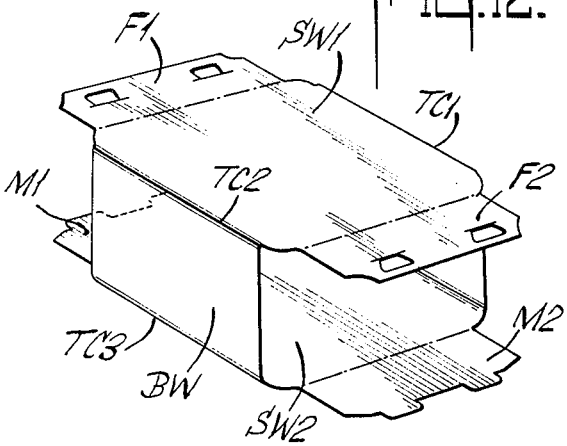
FIG. 12 is a perspective view of the carton in open condition preparatory to receiving in its opposite ends the number of cans for which it is designed.
Figure 13:
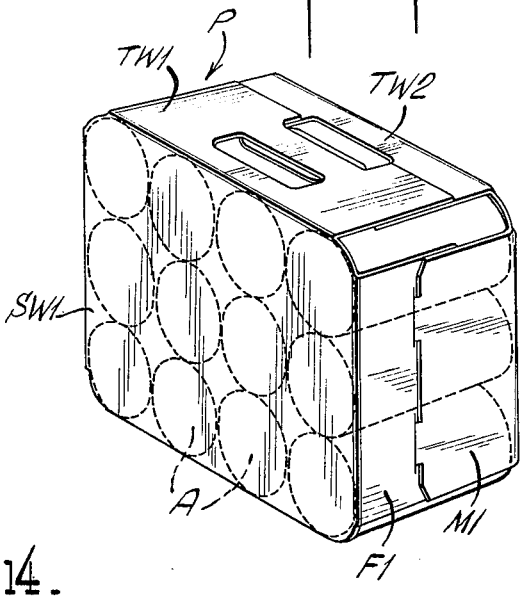
FIG. 13 is a perspective view of the completed package.
Figure 14:
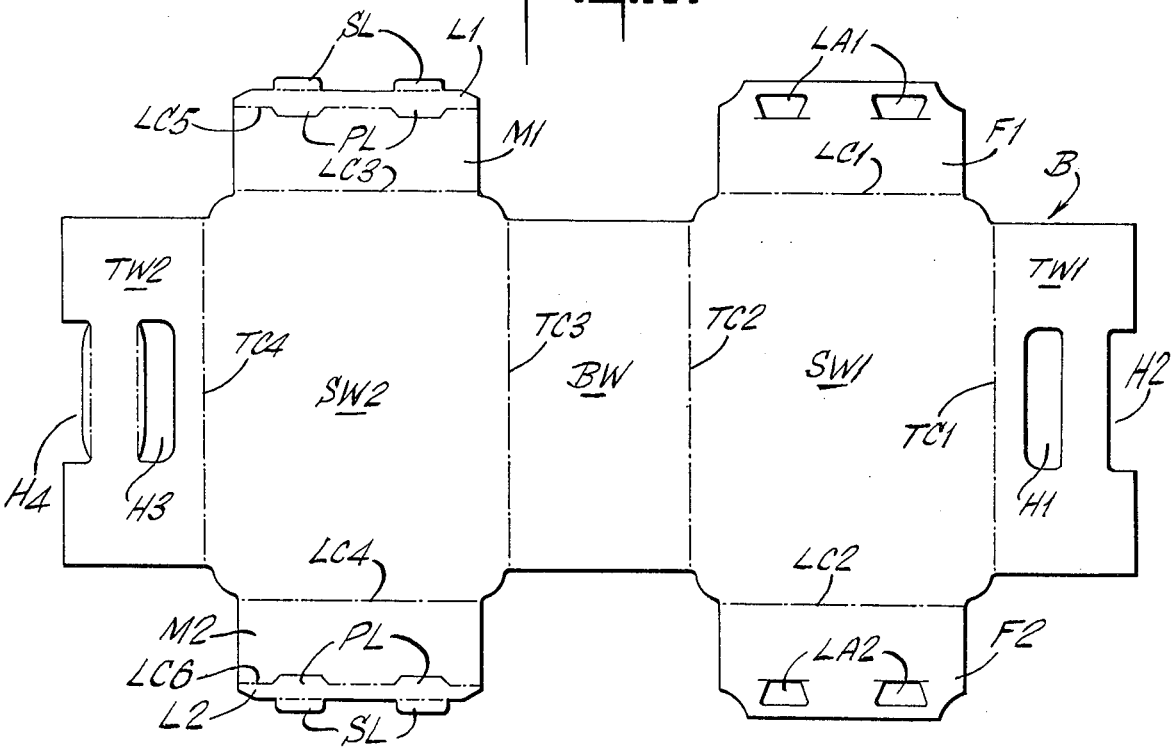
FIG. 14 is a plan view of the blank which is employed ı fabricating the carton.

Referring to FIG. 13, there is illustrated a can packge P which is adapted to be formed by enclosing in a arton C a group or assembly of beverage cans or bevrage filled containers, in the form of cans, or other roduct elements, or articles of similar character. The arton or carrier C is fabricated from blank B of paperoard or other suitable package forming sheet material, hich is cut and scored as shown in FIG. 14. The carn C is adapted to be fabricated initially in flattened ıbular form as illustrated in FIG. 11 for use on the resent machine in forming the package P of FIG. 13.

The blank B, which is of generally rectangular configration, is divided by transverse score lines or crease nes TC1, TC2, TC3 and TC4 which are spaced lengthise of the blank, into side wall forming sections SW1 nd SW2, and bottom and top wall forming panels BW, W1 and TW2. The latter two top wall forming panels W1 and TW2 are at the end of the blank and are dapted to be overlapped, in part, to form the top wall, s shown in FIG. 13. The panels TW1 and TW2 have pertures in elongate, generally rectangular form which re cut therein at H1, H2 and H3, H4 which are dapted to be aligned in order to provide clearance for he fingers in grasping the intervening panel material so s to facilitate picking up the package or carrier. The ıne side wall panel SW1 has lateral extensions sepaated therefrom by parallel, longitudinally extending rease or score lines LC1 and LC2, which extensions onstitute end wall forming female panels F1 and F2 in hich locking apertures LA1 and LA2 are provided. he other side wall panels SW2 has lateral extensions f a similar character which are divided therefrom by ransversely spaced, parallel, longitudinal crease lines C3 and LC4, which extensions panels constitute end vall forming male panels M1 and M2. Panels M1 and 12 are adapted for co-operation with the female panls F1 and F2 in forming the end walls of the carton C. he male end wall panels M1 and M2 are provided with dentical locking panels L1 and L2 which are adapted o hinge on the score lines LC5 and LC6, respectively, ınd each of which is cut with a pair of primary locking ongue elements PL and secondary locking tab elenents SL spaced in accordance with the spacing of the ocking apertures LA1 and LA2 in the female panels 1 and F2 with which they are adapted to co-operate in ecuring the panels together in end wall formation.

The illustrated carrier or carton is adapted to be abricated at the manufacturing plant, for delivery to he canning plant, in collapsed or flattened condition, y folding the blank B on transverse score lines TC2 ınd TC4 with the panel TW2 overlying the panel TW1 ınd secured thereto by an adhesive or other fastening neans. The folded or collapsed carton assembly C, hich is then in the condition shown in FIG. 11, is lelivered to the canning plant for forming the package as illustrated in FIG. 13.

Referring to FIGS. 1 to 10, there is illustrated an ıpparatus embodying the principles of the present inention which is adapted to be employed in forming the package shown in FIG. 13 which package comprises a group of 12 cans arranged 6 cans in each end of the carton and in transverse and longitudinal row alignnent. As shown in FIG. 13, the corners of the carton ıre cut away, exposing portions of the corner cans and enabling the closure panels to be tightly drawn together n closing so as to insure a relatively tight wrap whereby the cans are restrained against any appreciable movement within the carton when the carton is filled and closed. The carton illustrated in FIGS. 11 to 14 has the basic construction shown in application Ser. No. 345,126, filed Mar. 26, 1973, by Edwin L. Arneson and Guelfo A. Manizza, and now U.S. Pat. No. 3,894,681 to which reference may be had for details not herein described.

Figures 1, 2B:
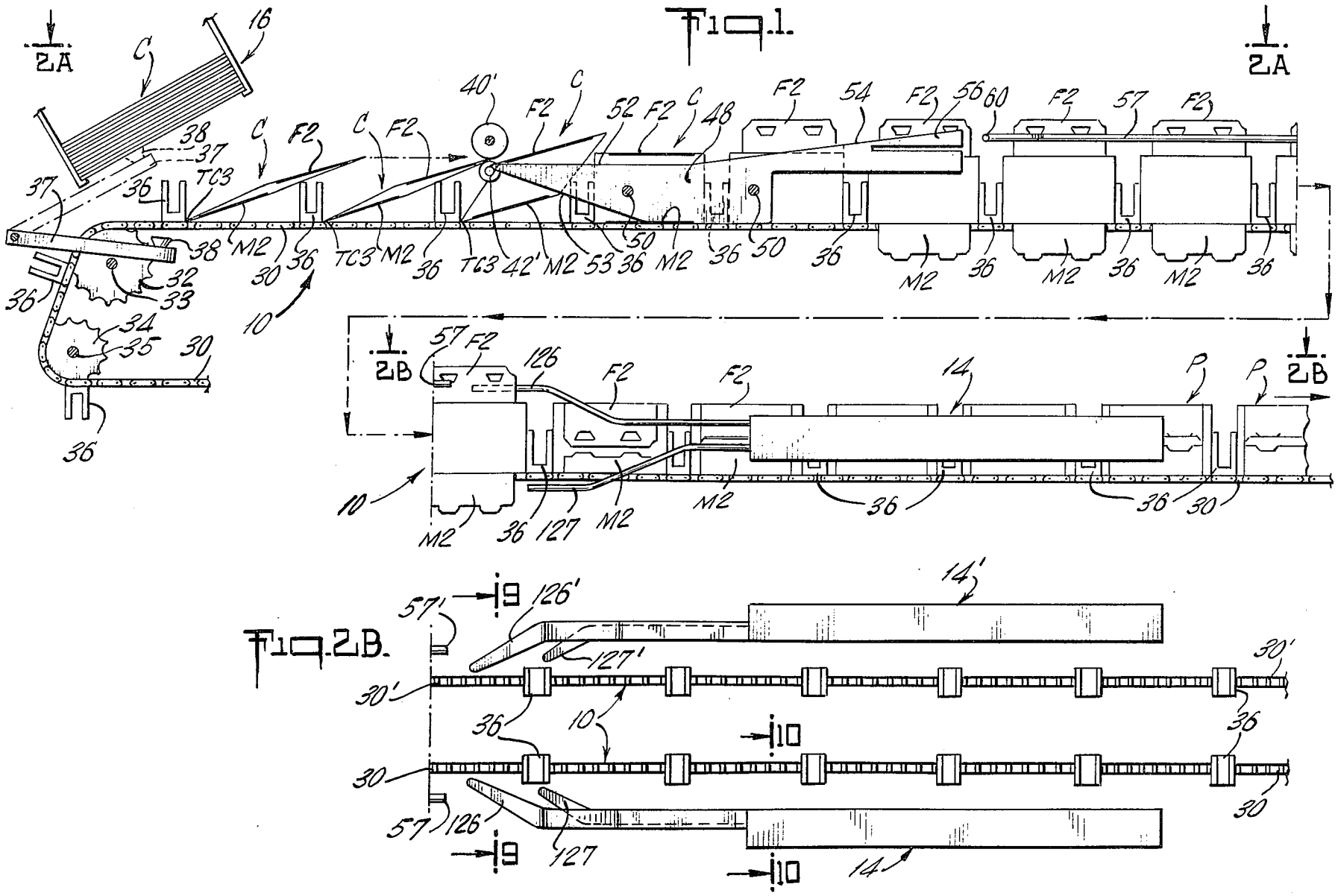
FIG. 1 is an elevational view, largely diagrammatic, showing the main portion of a carton opening, filling and closing machine which embodies therein the principal features of the invention, the machine being adapted particularly for the packaging of 12 beverage cans.
FIG. 2B is a plan view of the discharge end of the machine, the view being taken on the line 2B—2B of FIG. 1 to an enlarged scale and with portions broken away or omitted.

As illustrated in FIGS. 1 to 3, the machine comprises a traveling conveyor assembly 10 onto which collapsed cartons C are fed and then supported while they are opposed up and advanced first to a loading area or station 12, where they are filled with the required number of cans from the opposite ends thereof, and then carried through an end panel closure mechanism indicated at 14 (FIG. 2B) for completing the package P in the form shown in FIG. 13. The cartons C, in collapsed condition (FIG. 11), are supplied at the entrance end of the conveyor 10 from the hopper 16 and the cans are supplied by feed lines 18 and 18′ running along opposite sides of the conveyor 10 and delivering double lines of the cans to transverse aligning mechanisms 20 and 20′ which in turn deliver the cans to group segregating mechanism 22 and 22′ and co-operating associated means 24 and 24′ for controlling the movement of the cans along converging paths which extend to the loading area 12 and for inserting the cans, in two groups of three cans each, into the opposite open ends of successive advancing cartons C. The conveyor 10 travels continuously and the means 24 and 24′ for controlling the movement of the cans and for inserting them into the carton ends are operated so as to accomplish the loading without interrupting the advance of the conveyor 10.

The conveyor 10 (FIGS. 1 to 3) comprises a pair of endless chains 30 and 30′ which are transversely spaced and operated in parallel, vertical planes with the trailing ends thereof supported on pairs of upper sprockets 32 and 32′ on a transverse shaft 33 while the lower return run travels about similar sprockets 34 mounted on a parallel transverse shaft 35 at a lower level. The leading end of the chains 30 and 30′ are supported in a similar manner on suitable shaft supported sprockets and connected to a suitable drive mechanism (not shown). The chains 30 and 30′ carry longitudinally spaced, carton engaging and spacing blocks or lugs 36 which extend outboard of the chains and which may be of U-shaped cross section as illustrated. The spacer blocks or lugs 36 are arranged in transversely aligned pairs and the spacing between each lug 36 and the preceding lug 36 corresponds approximately to the transverse dimension of a larger side wall of the carton C, that is, the dimension in the lengthwise direction of the blank between the score lines TC1 and TC2 (FIG. 14) so as to permit the cartons, when they are opened to tubular shape to seat in the pocket formed between the successive pairs of lugs 36.

Figure 5:
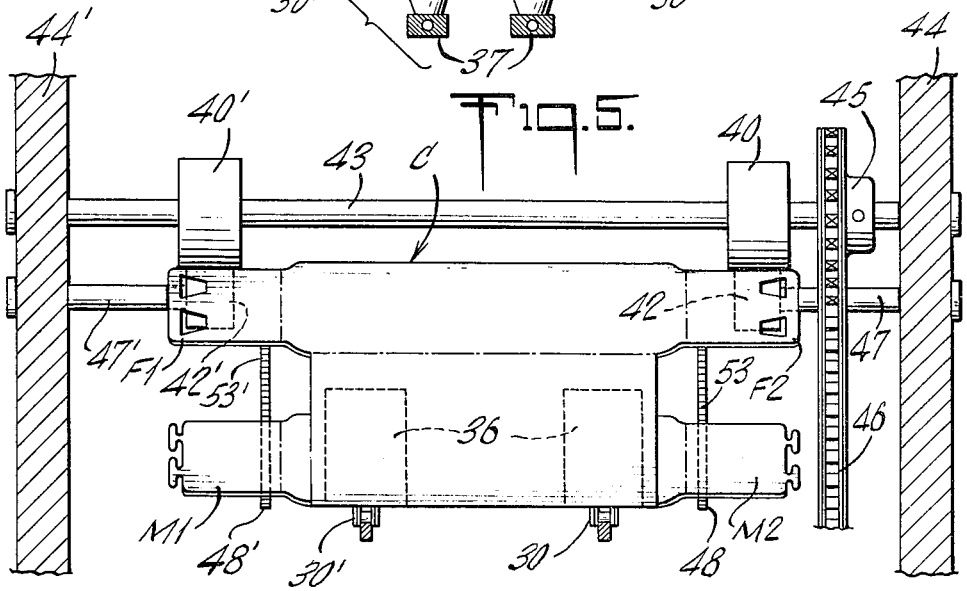
FIG. 5 is a cross sectional view taken on the line 5—5 of FIG. 2A to an enlarged scale.
Figure 6:
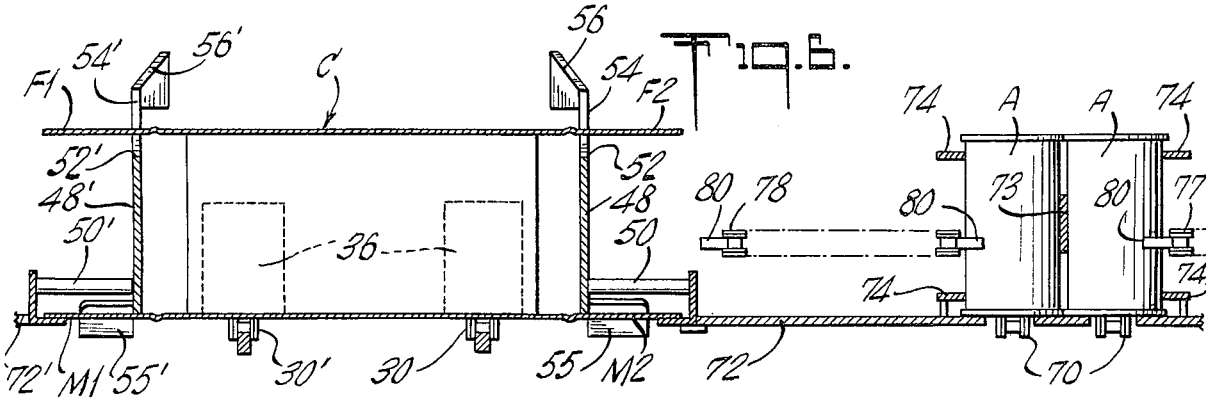
FIG. 6 is a cross sectional view taken on the line 6—6 of FIG. 2A to an enlarged scale.

Collapsed cartons C in the condition shown in FIG. 11 are supplied from the hopper 16 which is suitably supported above the trailing end of the conveyor 10 as shown in FIG. 1. Successive cartons C are fed from the bottom of the hopper 16 by a pivotally mounted reciprocating feed arm assembly 37 having a pair of vacuum cups 38 mounted on the free end of the feed arm which are adapted to engage and grip the upwardly inclined, lowermost surface of the bottom carton in the hopper 16. The arm 37 is connected to a power operating means and is reciprocated in timed relation to the movement of the conveyor 10 so as to feed successive collapsed cartons C onto the conveyor with the trailing edge of each collapsed carton engaged by a pair of spacer blocks or lugs 36 for advancing the same and with the body of the carton resting on the preceding conveyor block 36 in the inclined position as shown in FIG. 1. The leading edge of the carton is elevated so that it is traveling in a horizontal plane above the travel of the conveyor run. As the cartons advance the leading edges of the female end closure panels F1 and F2 enter the bight of the gripping rollers (FIGS. 2A and 5) 40, 40' and 42, 42' which are mounted as shown in FIG. 5 above the top run of the conveyor 10. The top rollers 40 and 40' are carried on a cross shaft 43 which is supported at its ends on side frame member 44 and 44' and which carries a sprocker 45 connected by chain 46 to a suitable drive member. The lower rollers 42 and 42' are mounted on stub shafts 47 and 47' which shafts are also supported on the frame members 44 and 44'. The shaft 43 is driven at a speed which results in lineal travel of the female panels F1 and F2 at a rate less than the advance of the conveyor 10 so that the uppermost panel SW1 and associated female panels F1 and F2 are held back while the bottommost panel SW2 and associated end closure panels M1 and M2 are moved ahead under the influence of the carton engaging lugs 36 resulting in an opening up of the carton and the seating of the same in the conveyor pocket formed by the spaced pairs of lug members 36.

As the carton is advanced through the panel gripping rollers 40, 42 and 40', 42' it is moved forward between plow forming folding blades or plates 48 and 48' (FIGS. 1, 2A and 6) mounted on supporting frame structures 50 and 50' and disposed at opposite sides of the conveyor run in generally parallel planes, with the top edges 52, 52' at the entrance end being generally horizontal and the bottom edges 53, 53' tapering downwardly, these edges being at an elevation so that the closure panels F1 and F2 will ride on the top edges 52 and 52' while the bottom closure panels M1 and M2 will ride on the downwardly tapered bottom edges 53 and 53'. As the closure panels move through the bight of the gripping rollers 40, 42 and 40', 42' and advance immediately beyond the same into the side plate area the carton is opened up, or squared up, into tubular shape and is seated in the pocket between the two pairs of spacer lugs 36 on the conveyor top run, with the open ends at opposite sides of the path of the conveyor.

Figure 7:
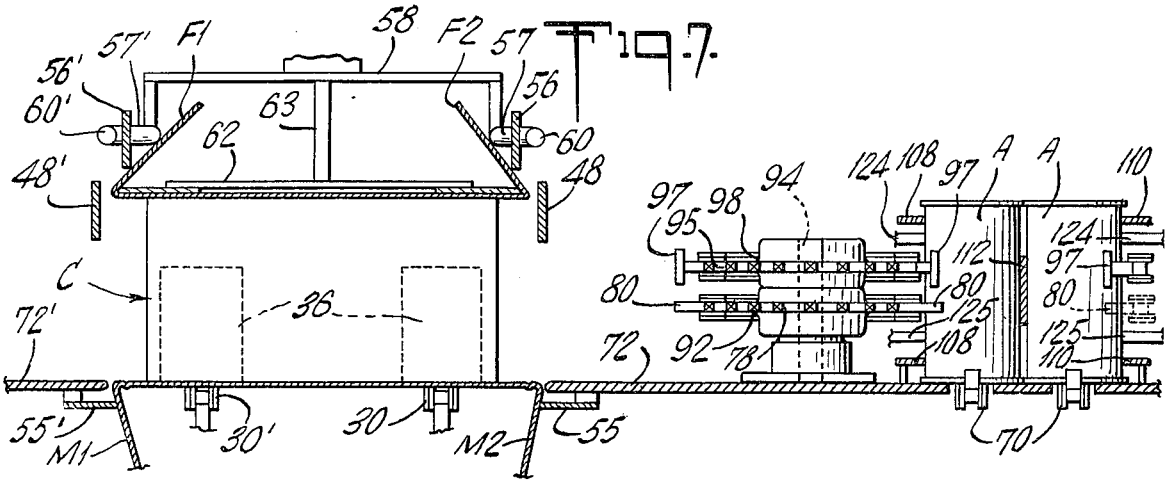
FIG. 7 is a sectional view taken on the line 7—7 of FIG. 2A to an enlarged scale.

The top edges 52 and 52' of the folder plates or plows 48 and 48' merge into upwardly inclined edge portions 54, 54', as the cartons are advanced, which engage and fold the female panels F2 and F1 into an upstanding position while the lower male panels M1 and M2 engage bottom plow members 55 and 55' (FIG. 6) which fold, or plow, the panels M1 and M2 into downwardly extending position, as shown in FIGS. 1 and 7. The leading end portions 56 and 56' of the plow members 55 and 55' are turned inwardly towards the conveyor chains 30 and 30' and bend the flaps F1 and F2 to a position where they pass onto the inside of the rods 57 and 57' which are supported on an overhead cross frame structure 58 and which have outwardly flared portions 60 and 60' at the entrance end. A horizontally disposed top plate structure 62 is supported by post 63 depending from the cross frame 58 which forms a top support and guide member for the cartons as they are advanced along beneath the same at the loading station. The rods 57 and 57' hold the topmost closure flaps F1 and F2 folded back above the open ends of each carton as it reaches the loading area 12 so as not to interfere with the loading of the cans therein.

Figure 2A:
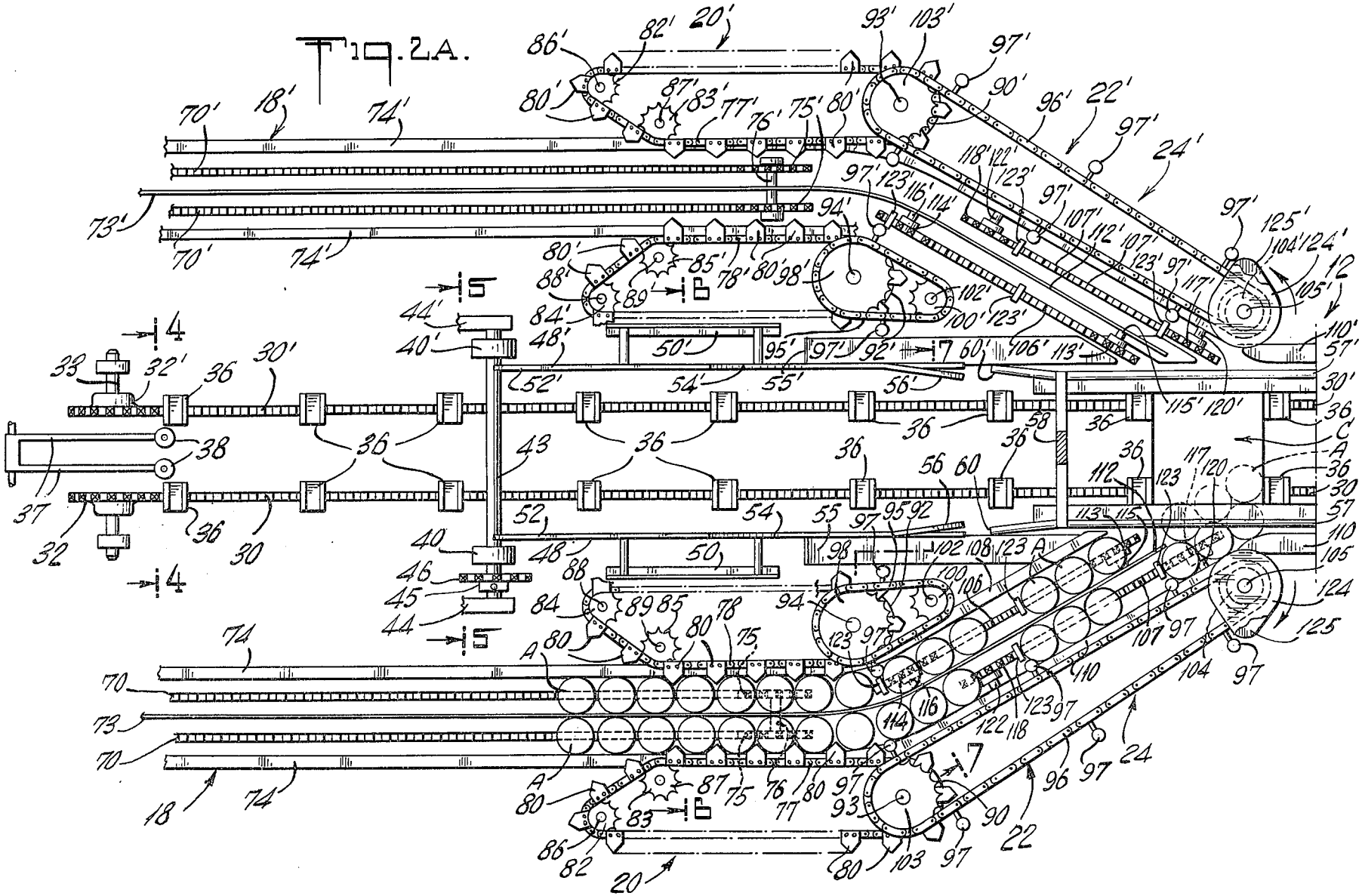
FIG. 2A is a plan view showing the entrance end of the machine, the view being taken on the line 2—2 of FIG. 1, to an enlarged scale and with portions broken away.
Figure 4:
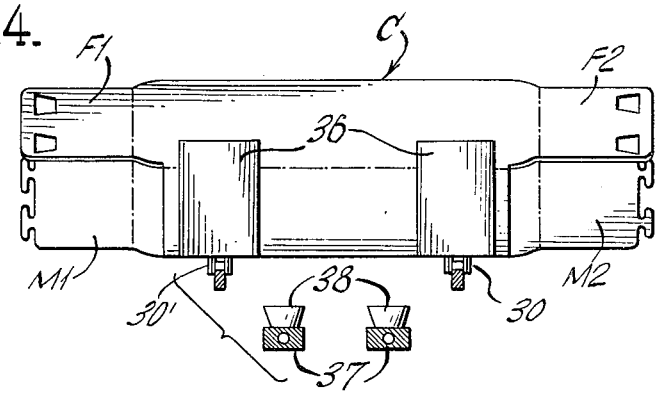
FIG. 4 is a fragmentary cross section taken on the line 4—4 of FIG. 2A to an enlarged scale.

The can infeed lines 18 and 18' on opposite sides of the conveyor 10 are of identical construction and only one arrangement will be described with corresponding elements on the other side being identified by the same numerals primed. The aligning mechanisms 20 and 20' and the grouping and loading mechanisms 22, 24 and 22', 24' on opposite sides of the conveyor 10 are also of identical construction except for being in a right and left arrangement. The arrangement on one side only will be described and corresponding elements on the other side will be identified by the same numerals primed. The infeed conveyor 18 comprises a pair of chains 70 (FIGS. 1, 6 and 7) arranged in parallel relation with the upper can carrying runs thereof operating in slots in a can support plate structure 72, the latter extending to the loading station 12 and supporting also the can handling structures. The can carrying chain runs advance two lines of cans in side-by-side relation and the structure includes a line separator blade 73 and guide members 74 on either side of the path. The chains 70 are supported at the leading end thereof on a pair of sprockets 75 which are suitably supported on a driven cross shaft 76. The infeed conveyor 18 advances the double line of cans into the can aligning mechanism 20 which includes a pair of endless chains 77 and 78 supported for operation in horizontal planes on opposite sides of the conveyor 18 at the leading end thereof, as best seen in FIG. 2A. The chains 77 and 78 are each provided with a series of spaced, can engaging plate members, forming spacer lugs 80, which are of identical construction, and which have outboard ends with converging edges adapted to fit between a pair of cans which are following each other on the conveyor 18. The chains 77 and 78 are mounted for travel in a generally rectangular path at oppositely disposed runs of opposite sides of the conveyor 18 and with the lugs 80 arranged in tranversely aligned pairs. At the trailing ends the chains 77 and 78 are supported on laterally spaced pairs of sprockets 82, 83 and 84, 85 which are carried on vertically disposed shafts 86, 87 and 88, 89 upstanding from the frame support plate 72. At the leading ends the chains 77 and 78 are supported on sprockets 90 and 92 which are carried on vertical shafts 93 and 94, also upstanding from the frame support plate 72 (FIG. 7). The sprockets 82, 83 and 84, 85 are in offset arrangement longitudinally of the conveyor 18 so as to provide a funnel-like entrance between the opposed runs of the chains 77 and 78 for entrance of the spacing or aligning lugs 80 between the cans. The sprockets 90 and 92 at the leading ends of the chains 77 and 78 are of a larger diameter so that the chains 77 and 78 travel in a generally rectangular path on each side of the conveyor 18.

The vertical shafts 93 and 94 are also offset in the longitudinal direction with the outermost shaft 93 disposed ahead of the innermost shaft 94 which results in a greater length for the outermost chain 77 and a longer path for the innermost run of the chain 77. At the end of the conveyor 18 the cans are segregated into groups of three by the grouping mechanism 22. The groups in the outermost one of the two supply lines fall behind the groups in the innermost line due to the change in the direction of travel which from the end of conveyor 18 is inclined in the direction of the conveyor 10 so as to direct the cans to the loading station 12.

The mechanism 22, at one side of the machine, (FIG. 2A) for grouping the cans in groups of three cans in a row in each of the two lines which have been forwarded by the conveyor 18, comprises an inner or inboard grouping conveyor assembly or chain 95 (FIGS. 2A and 7) and an outer or outboard grouping conveyor assembly or chain 96, the two being disposed on opposite sides of the can supporting and advancing structure 24 and operating in a common horizontal plane. The two chains 95 and 96 have can engaging lugs 97 spaced lengthwise the proper distance to form the three can groups. The inboard chain 95 has a relatively short length with one end supported on a relatively large diameter sprocket 98 on the vertically disposed driven shaft 94 and the other end supported on a relatively small diameter idler sprocket 100 which is mounted on the vertically disposed idler shaft 102. The outboard chain 96 is of greater length than the chain 95 and is supported at the trailing end on a sprocket 103 carried on the vertically disposed shaft 93. At the leading end the chain 96 is supported on a sprocket 104 (FIG. 8) carried on the vertically disposed shaft 105 which is immediately adjacent the loading station 12. The inboard chain 95 is driven by a suitable drive connection with the vertical shaft 94. The outboard chain 96 is driven by a suitable drive connection with the vertical shaft 93. The can engaging and grouping lugs or fingers 97 are spaced on the chains and timed so as to group the cans as shown in FIG. 2A, with the groups in the outermost line trailing the oppositely disposed groups on the innermost line. The groups of cans are advanced to the loading area by bottom conveyor chains 106 and 107 operating in parallel vertical planes with their upper runs supporting the groups of cans in the two lines and advancing them into the open end of the carton at the loading station 12. The cans are confined in the two lines by side guide rails 108 and 110 and a center guide and separating plate 112. The innermost chain 106 is supported on longitudinally spaced sprockets 113 and 114 at the leading and trailing ends, respectively, with the leading sprocket 113 on a horizontally disposed shaft 115 and the trailing sprocket 114 on a horizontal shaft 116, one of the shafts being driven in a suitable manner. The outermost chain 107 is supported on longitudinally spaced sprockets 117 and 118, at the leading and trailing ends, respectively, with the leading sprocket 117 on a horizontally disposed shaft 120 and the trailing sprocket on a horizontal shaft 122, one of the shafts being driven. The chains 106 and 107 have longitudinally spaced lugs 123 which engage the trailing can in each group and advance the groups into the open end of a carton. The lugs 123 on the innermost chain 106 are mounted relative to the lugs 123 on the outermost chain 107 and the chains are timed relative to each other and to the carton conveyor 10 so as to advance each group of cans on the innermost chain 106 for entry into the open end of a carton somewhat ahead of the associated group on the outermost chain 107 and the timing and spacing are such that the entry of the cans occurs smoothly. In order to provide for positive control of the entry of the last cans a pair of cam plates 124 and 125 are mounted in axially spaced relation on the vertical shaft 105 which have on their edge surfaces can engaging tracks of a configuration on which, upon rotation, will cam the last can in the group into proper position in the end of the carton so that the end closure panels may be closed without interference.

As the filled cartons are advanced beyond the loading area or station, the side guide rails 57 and 57′ terminate and the end closure panels of flaps are engaged by top and bottom plow forming plate members 126, 127 and 126′, 127′ which extend along the opposite sides of the path of the conveyor 10 and which have panel engaging edges contoured to swing the closure panels toward closed position in proper order for operation of the latching and locking mechanisms 14 between which the cartons are advanced to complete the closing and interengagement of the male and female panel elements. The locking and latching mechanisms 14 which operate on the end closure panels F1, M1 and F2, M2 to engage the primary PL and secondary SL locking and latching elements of panels M1 and M2 in the co-operating apertures LA1 and LA2 in the panels F1 and F2 may be of the construction which is illustrated in U.S. Pat. No. 2,986,857, granted June 6, 1961, for locking and latching the interengaging elements on the bottom wall forming or bottom closing panels of the wraparound type package, or of a similar construction.

The use and operation of the machine will be apparent from the foregoing description. The machine requires only the maintaining of a supply of collapsed cartons in the hopper 16 and a supply of cans on the can infeed conveyors 18 and 18′. A control mechanism may be employed with appropriate sensors, properly placed, to monitor the feeding of the cartons and cans and to stop the machine when there is a malfunction or failure in the supply lines.

We claim:

1. In a package forming machine adapted for opening collapsed tubular cartons of the type which have on oppositely disposed ends pairs of co-operating closure panels hinged to the carton side walls which closure panels have marginal portions adapted to be overlapped and secured by interengaging locking elements when said panels are hinged to end closing position and for loading the open cartons by feeding into the oppositely disposed open ends of each carton a plurality of product containers in the form of beverage cans, an endless traveling conveyor having a carton supporting run arranged to travel in a generally horizontal path, means for feeding successive collapsed cartons into said carton supporting conveyor run, means co-operating with said conveyor for opening and squaring up the successive cartons with the end closure panels folded so as to extend above and below the plane of the associated side walls and with the ends open in the direction outboard of opposite sides of the carton conveyor, means for driving said carton conveyor so as to advance the cartons in open condition to a loading station, a can feeding conveyor disposed on each side of said carton conveyor with a can supporting run traveling in a path generally parallel with the path of the carton conveyor, said can supporting run of each said can feeding conveyor advancing lines of cans in transverse, side-by-side relation, means for driving said can feeding conveyor, traveling conveyor means at the leading end of said can feeding conveyor for advancing the lines of cans which conveyor has a can supporting run disposed for travel in a diagonal path extending from the leading end of said can feeding conveyor to said loading station, means adjacent the leading end of said can feeding conveyor for aligning the cans transversely of the conveyor path, means at the leading end of said can feeding conveyor for grouping the cans in each line thereof into successive groups of three cans each, means for advancing the cans along said diagonal path in transversely paired groups and means for discharging said groups of cans from said group advancing means and for inserting the groups of cans in paired relation into the open end of a carton which is advanced to said loading station on said carton conveyor.

2. A packaging machine for opening and loading collapsed tubular cartons which are adapted for packaging canned products, or the like, said cartons being of the type which have end closure panels hinged to opposite ends of oppositely disposed side wall forming panels, said packaging machine comprising a carton supporting conveyor having a run thereof disposed for travel in a generally horizontal path, means for depositing successive collapsed cartons on said conveyor run, means along said carton carrying conveyor run for opening up each said carton into tubular shape with the carton supported on said conveyor so that oppositely disposed ends open in a direction outboard of the sides of the path of the carton conveyor, means for driving said carton supporting conveyor so as to advance the cartons to a loading station, endless traveling can feeding conveyors arranged along opposite sides of the carton supporting conveyor, each of said can feeding conveyors having a can supporting run thereof traveling in the same direction as the carton supporting conveyor run, means for driving said can feeding conveyors in timed relation to the movement of said carton conveyor, said can feeding conveyors each having said can supporting run terminating short of said loading station with the leading end thereof spaced longitudinally and laterally from said loading station, endless traveling conveyor means having a can supporting run extending from the leading end of each said can feeding conveyor to said loading station and having can supporting and advancing means for delivering groups of cans to said loading station and continuously traveling means co-operating with each said can feeding conveyor and the associated diagonally extending conveyor group supporting and advancing means at the leading end of said can feeding conveyor for segregating groups of the cans and advancing the groups of cans in predetermined spaced relation to said loading station for delivery into the ends of a carton advanced to said loading station.

3. A packaging machine as set forth in claim 2 wherein said carton supporting conveyor has a plurality of block members fixed thereon in spaced relation longitudinally of said conveyor, successive block members being spaced a predetermined distance corresponding approximately to the transverse dimension of a side wall panel of the carton which is to be supported thereon when the transverse dimension of the side wall panel extends in the direction longitudinally of the conveyor.

4. A packaging machine as set forth in claim 2 wherein said carton supporting conveyor has a plurality of carton engaging and spacing members which are spaced a predetermined distance apart longitudinally of the conveyor, with the spacing being less than the corresponding dimension of the carton when said carton is deposited thereon in collapsed condition, said means for depositing successive collapsed cartons on said conveyor being operative to deposit each successive carton with the trailing edge abutting the forward side of one of said carton engaging and spacing members, and wherein said carton opening means includes means for engaging the topmost end closure panels of each successive carton so as to retard the advancing movement thereof relative to the advancing movement of the conveyor thereby to cause each carton to open into tubular form and to seat in a pocket formed between successive carton engaging and spacing members while it is advanced by movement of said conveyor.

5. A packaging machine as set forth in claim 4 wherein said means for engaging the topmost end closure panels comprises pairs of gripping rollers disposed at opposite sides of and above the carton supporting conveyor so as to receive the topmost carton end closure panels in the bite thereof, and means to drive said gripping rollers so that the linear speed of said topmost end closure panels is less than the linear speed of the carton supporting conveyor.

6. A packaging machine as set forth in claim 2 wherein said carton supporting conveyor has longitudinally spaced abutment forming members facing forwardly in the direction of advance of said conveyor, and said means for depositing collapsed cartons on said conveyor is operative to deposit the successive cartons with the trailing edge of each carton engaged by an abutment member, and wherein said means for opening up each carton includes means disposed along a portion of the conveyor path for gripping end closure panels which are in topmost position and retarding the advance thereof while the abutment member which engages the carton advances at a greater rate of speed and causes the carton to open up and seat on the conveyor in front of the abutment member for advance to said loading station.

7. A packaging machine as set forth in claim 6 wherein said carton supporting conveyor has means at the loading station for engaging the topmost side of the opened carton as it is advanced to said station so as to square up said carton and hold it in open condition at said station for receiving the cans through the open ends.

8. A packaging machine as set forth in claim 6 wherein plow forming means is spaced along said carton conveyor for engaging said end closure panels on opposite sides of said conveyor when said carton is opened up and for hinging said end closure panels to a position where they will not interfere with the entry of the cans into the ends of the carton.

9. A packaging machine as set forth in claim 2 wherein said can feeding conveyors are arranged to advance two lines of cans in side-by-side relation and wherein said means at the leading end of said can feeding conveyor for segregating groups of cans also advances the segregated groups of cans in pairs with the outermost group lagging the associated innermost group of each pair thereof.

10. A packaging machine as set forth in claim 2 wherein said can feeding conveyors are arranged to advance two lines of cans in side-by-side relation and wherein said conveyor means extending from the leading end of each said can supporting conveyor run comprises parallel endless traveling conveyor members each having a can supporting run with longitudinally spaced, can engaging lugs which are in offset relation transversely of the path of advance so as to advance paired groups of the cans in the two lines with the outermost group lagging the innermost group in each pair thereof.

11. A packaging machine as set forth in claim 2 vherein can engaging cam means is provided adjacent he path of the conveyor means which extends from aid can feeding conveyors to said loading station and djacent the loading station which cam means is operaive to engage a trailing can at the carton entrance and nove the can into the carton.

12. A packaging machine as set forth in claim 11 vherein said cam means comprises a cam plate supported on a vertical shaft with a cam track edge moving n a path to engage a trailing can in a group thereof vhich is entering a carton at the loading station and drive means operative to rotate said cam plate so as to orce said trailing can into the carton end.

13. A packaging machine for opening and end loading collapsed tubular cartons which are adapted for packaging articles having the general form of canned products, or the like, said cartons being of the type vhich have end closure panels hinged to opposite ends of oppositely disposed side wall forming panels, said packaging machine comprising a carton supporting conveyor having a run thereof disposed for travel in a generally horizontal path, means for depositing successive collapsed cartons on said conveyor run, means associated with said carton carrying conveyor for opening up each said carton into tubular shape with the carton supported on said conveyor so that oppositely disposed ends are open in a direction outboard of the sides of the path of the carton conveyor, means for driving said carton supporting conveyor so as to advance the cartons to a loading station, article feeding conveyors arranged along opposite sides of the carton supporting conveyor, means for driving said article feeding conveyors with an article supporting run thereof advancing in the same direction as said carton supporting conveyor run, said article feeding conveyors each having said article supporting run terminating short of said loading station with the leading end thereof spaced longitudinally and laterally from said loading station, means extending along a diagonal path from the leading end of each said article supporting run to said loading station and including article supporting and advancing means for delivering groups of the articles into the open ends of a carton advancing at said loading station on said carton conveyor and traveling means extending at least in part along said diagonal path for segregating said articles into groups of a predetermined number.

14. A packaging machine as set forth in claim 13 wherein said article feeding conveyors are arranged to advance at least two lines of articles and wherein article aligning means is provided which extend along opposite sides of said article feeding conveyors to align the articles in the lines in the direction transversely of the advance of the conveyors.

15. A packaging machine as set forth in claim 13 wherein said article feeding conveyors are arranged to advance at least two lines of the articles and wherein said article supporting and advancing means which extends from the leading ends of said article feeding conveyors has associated endless conveyor means for grouping the articles in each line into groups of a predetermined number for insertion into the carton open ends.

16. A packaging machine as set forth in claim 13 wherein said article supporting and advancing means which extends from the leading end of each article feeding conveyor has associated means adjacent the loading station for engaging trailing articles and forcing them into the carton ends without interrupting the advance of the carton.

17. A packaging machine as set forth in claim 13 wherein said article supporting and advancing means which extends from the leading end of each said article feeding conveyor comprises parallel endless conveyor members having article engaging lugs thereon arranged in longitudinally offset relation for advancing groups of articles into the ends of a carton traveling at said loading station.

18. A packaging machine as set forth in claim 13 wherein said article supporting and advancing means which extends from the leading end of each said article feeding conveyor has an associated cam means for camming the trailing article of a group into final position in the carton end.

* * * * *